United States Patent [19]

Blackburn

[11] Patent Number: 4,753,182

[45] Date of Patent: Jun. 28, 1988

[54] SEAM FOR PROTECTIVE GARMENT

[75] Inventor: William A. Blackburn, Chapel Hill, N.C.

[73] Assignee: Disposables, Inc., Manhasset, N.Y.

[21] Appl. No.: 58,555

[22] Filed: Jun. 5, 1987

[51] Int. Cl.[4] ..... A41D 27/24; B32B 7/08

[52] U.S. Cl. ..... 112/419; 112/441; 2/275

[58] Field of Search ..... 2/275, 243 R; 112/419, 112/418, 440, 441, 429, 434, 262.2, 269.1, 262.1

[56] References Cited

U.S. PATENT DOCUMENTS

| | | | |
|---|---|---|---|
| 2,988,457 | 6/1961 | Gatcomb | 2/225 X |
| 3,294,617 | 12/1966 | Way | 161/36 |
| 3,563,198 | 2/1971 | Johnson | 112/441 X |
| 4,272,851 | 6/1981 | Goldstein | 2/79 |
| 4,555,293 | 11/1985 | French | 2/225 X |
| 4,561,128 | 12/1985 | Zimmerman | 2/275 |
| 4,622,908 | 11/1986 | Tranberg | 112/262.2 |
| 4,641,475 | 2/1987 | Berridge | 52/584 |
| 4,683,593 | 10/1985 | Langley | 2/82 |

FOREIGN PATENT DOCUMENTS

| | | | |
|---|---|---|---|
| 2458238 | 2/1981 | France | 2/225 |

OTHER PUBLICATIONS

"With Durafab you can Wear Whatever Seam's Appropriate," advertisment by Durafab, Post Office Box, 658 Cleburn, Tex. 76031, Appearing at p. 49 of the Jul. 1987 Issue of Occupational Hazards Magazine.

*Primary Examiner*—H. Hampton Hunter

*Attorney, Agent, or Firm*—Steven J. Hultquist

[57] ABSTRACT

A seam assembly for joining adjacent web panels, comprising a bound seam on a first side of the adjacently positioned web panels, and a liquid penetration-resistant tape longitudinally and sealingly extending along the seam line formed by the bound seam on a second side of the adjacently positioned panels. Also disclosed is a protective garment article utilizing a seam assembly of such type, and an appertaining method of forming such seam assembly. The seam assembly of the invention is highly useful in forming hazardous material suits, of a type employed to clean up liquid and solid chemical spills, and the like.

12 Claims, 1 Drawing Sheet

SEAM FOR PROTECTIVE GARMENT

BACKGROUND OF THE INVENTION

1. Field of the Invention

This invention relates to a seam construction useful in protective garments.

2. Description of the Related Art

In the field of protective garments, a variety of types of garment articles have evolved for protection of the body against environmental contaminants, including toxins and other materials which are deleterious or undesirable in contact or exposure to the body.

Such garments range in character from conventional laboratory coats, which protect the trunk and arm areas against immediate contact with liquids or solids, but which are readily permeable to fluids and afford minimal protection to the extremities and head of the wearer, to so-called emergency response suits, which are gas-tight in character and designed to afford maximum whole body protection in applications such as clean-up of toxic wastes and chemical spills.

Between these extremes, there has evolved a need for protective garments which cover the body of the wearer, and afford protection against liquid penetration, as a "splash barrier" in instances where liquids of a toxic or hazardous character are being handled, or where liquid clean-up is required. Such hazardous material suits are not gas-tight as are high-cost emergency response suits, yet they possess a high resistance characteristic to liquid penetration.

Inasmuch as it is generally impractical to integrally form an entire garment as a hazardous material suit, due to material and manufacturing limitations, cost constraints, and the like, there inevitably exist various garment sections or panels which are joined together at seams.

Such seams are critical regions of the garment as regards its utility. The panels of the garment may be formed of polymeric or laminated materials which are intrinsically liquid penetration resistant, or the panels may be sized or otherwise chemically treated with compositions imparting liquid permeation resistance thereto. Nonetheless, the seams afford a path of least resistance to liquid penetration, vis-a-vis the main panel portions of the garment.

Hazardous material suits are a developing field of protective garment technology, for which efficacy standards are currently being evolved by the National Fire Protection Association (NFPA), based on documentation developed by the American Society for Testing Materials (ASTM) F23 Committee. Current efforts in the hazardous material suit field are focused on the development of seams which for the gas-tight suits meet the permeation criterion of ASTM D739-85, and which for the liquid barrier suits meet the penetration criterion of ASTM F903-84. For example, the seams may be evaluated by exposure to a liquid penetration test medium, such as a mixture comprising 4 weight percent polychlorinated biphenyl, 6 weight percent trichlorobenzene, and 90 weight percent mineral spirits, or other multicomponent or single component test medium, which is applied to the seam area of a garment sample, and the breakthrough time to penetration is measured. A minimum suitable breakthrough time is one hour.

Significant difficulty has been experienced in designing seams to meet even such minimum breakthrough standard. There is accordingly a significant and continuing need for protective garments utilizing liquid penetration-resistant seams meeting such standard.

U.S. Pat. No. 3,294,617 to J. W. Way describes a reinforced seam for joining closed cell expanded elastomer panels, e.g., neoprene, in which the panels are butt-joined with a cement medium. In the reinforced seam of this patent, a semi-liquid, high viscosity elastomer is applied to the butt joint, preferably on the lining side of the seam, which then curingly forms an elastomeric ribbon chemically and mechanically bonding with the lining of the garment.

As disclosed at column 3, lines 16–26 of the Way patent, the ribbon-forming elastomers of the disclosed seam are self-curing at ambient temperature and atmosphere, by loss of water or solvent from the applied film. Water loss takes from approximately one to four hours, the loss of solvent(s) requires thirty minutes to one hour, and "curing requires several days to reach an optimum cure". It is therefore apparent that the curing conditions required restrict handling, shipment, and use of the seamed garment for the length of time required for the curing process to come to completion. In addition, when solvent-based elastomeric compositions are applied, it is apparent that there is a significant potential contamination problem due to the evaporation of solvents from the wet elastomeric film.

U.S. Pat. No. 4,272,851 to L. Goldstein discloses a protective garment for use in hazardous environments, the body of the garment being formed of a non-woven spunbonded olefin having a polyethylene film laminated to one side thereof. This garment utilizes bonded seams which are ultrasonically welded. A sewn binding is sewn externally of the bonded seam so that the welded seam is located between the stitching and the interior of the garment.

The Goldstein patent's protective garment utilizes ultrasonic bonding for seam formation, a process which requires close tolerances to be maintained in the thickness of the materials being welded, since even minute variations can result in either the "burn through" of the material if of less than the desired thickness, or of insufficient welding if the material is greater than the desired thickness. Very close control of the ultrasonic bonding apparatus is required in the welding operation for the same reasons, since an increase in ultrasonic generator frequency will produce undesirably higher intensity welding, and a decrease in frequency will result in lessening of the energy flux at the welding site, below the desired level. Further, the seam construction described in this patent entails the practical disadvantage that ultrasonically bonded seams are relatively rigid in character, so that when subjected to tensile load, such seams have a high probability of seam separation. The Goldstein patent does disclose the use of a bound seam in conjunction with the ultrasonically bonded seam, which is desirable to provide a high degree of mechanical integrity and reinforcement of the ultrasonically bonded seam, but does not overcome the intrinsic deficiencies of the ultrasonically welded seam. Among these deficiencies is the fact that the ultrasonically welded area is dimensionally small, and the failure of such welded area will result in extensive penetration of contaminants through the bound seam.

U.S. Pat. No. 4,641,475 to J. Berridge discloses a moisture resistant seam assembly for building structures in which an elongate seam is formed by adjoining mating flanges of adjacent channel-shaped building surface covering members. The assembly comprises a seam cover member, a seal means within the seam cover member, and an anchor clip. The seam cover member is positioned over the elongate seam, and the seal means therein sealingly engages the adjoining mating flanges for preventing fluid migration between the seal cover member and the elongate seam.

Another type of seam which has been employed in the joining of panels is a lap seam assembly in which the respective panels are lapped substantially in the plane of the panels when reposed on a flat surface, and overlaid with an adhesive tape. Such seam construction depends for its mechanical integrity on the shear and peel strength characteristics of the adhesive tape, and the bond produced between the tape and the panel substrate. These constructions are generally of low strength and structural integrity characteristics, and typically are not suitable for protective garments of the type contemplated by the present invention.

Bonded seams formed by hot melt adhesive joining methods are known in various garment applications, but have the disadvantage that they typically weaken the seam's supporting fabric by thermal degradation thereof during the seam-forming operation so that the mechanical properties of the supporting fabric, e.g., its tensile strength, are detrimentally reduced.

Accordingly, it would be highly desirable to provide an improved seam assembly for joining adjacent panels of a protective garment, utilizing a bound seam as desirable to provide a high level of structural integrity and mechanical strength of the garment in use, but which is highly penetration resistant to liquids, beyond the level of resistance provided by a bound seam per se.

It is therefore an object of the invention to provide an improved seam assembly of such type, utilizing a bound seam to impart mechanical strength and structural integrity, and which is moreover highly liquid penetration resistant.

It is another object of the invention to provide an improved seam assembly of such type, which can be formed in a quick, efficient, and economical manner at ambient (room) temperature.

Other objects and advantages of the invention will be more fully apparent from the ensuing disclosure and appended claims.

SUMMARY OF THE INVENTION

In one aspect, the invention relates to a seam assembly for joining adjacent web panels, comprising a bound seam on a first side of the adjacently joined web panels, a liquid penetration-resistant tape extending longitudinally and sealingly along the seam line formed by the bound seam on a second side of the adjacent web panels.

The invention in another aspect relates to a protective garment comprising at its seams a seam assembly of such type.

The invention in another aspect relates to a method of forming a seam assembly of such type wherein a bound seam is formed on a first side of adjacently positioned web panels, and a liquid penetration-resistant tape is longitudinally sealed on a second side of the adjacently positioned web panels to the seam line formed by the bound seam.

In a preferred aspect of the invention the web panels may comprise a polymeric material, e.g., a polymeric laminate containing successive layers formed of homopolymers and copolymers of olefins such as polyethylene and polypropylene, and other ethylenically unsaturated monomers such as vinyl chloride, vinylidene chloride, vinyl acetate, etc.

Other aspects, features, and embodiments of the invention will be more fully appreciated with reference to the ensuing disclosure herein.

DETAILED DESCRIPTION OF THE INVENTION, AND PREFERRED EMBODIMENTS THEREOF

Figure 1:
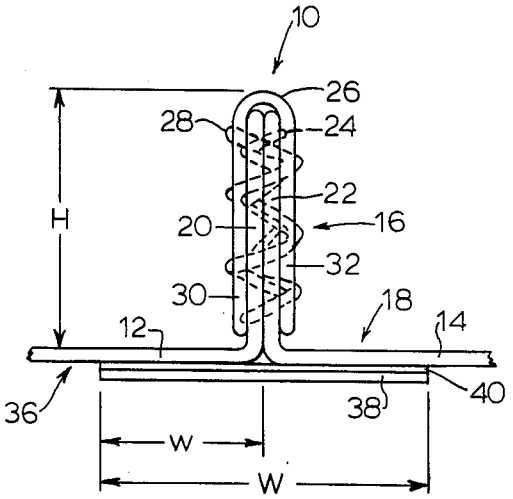
FIG. 1 is a sectional elevational view of a seam assembly according to one embodiment of the present invention.
Figure 2:
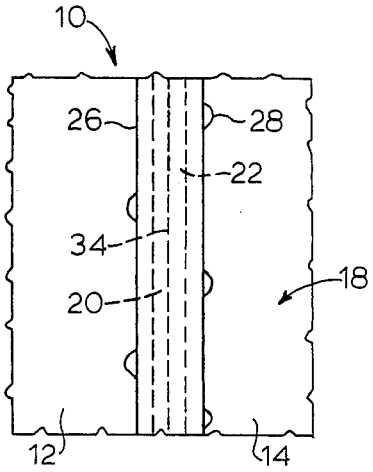
FIG. 2 is a top plan view of the seam assembly of FIG. 1.
Figure 3:
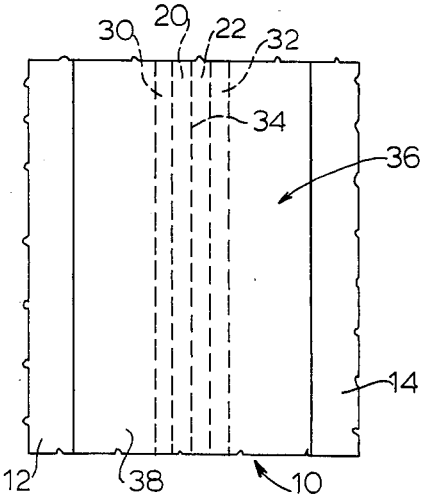
FIG. 3 is a bottom plan view of the seam assembly of FIG. 1.

Referring now to the drawings, FIG. 1 shows a sectional elevation view of a seam assembly according to one embodiment of the present invention, with FIGS. 2 and 3 representing top and bottom plan views thereof.

The seam assembly 10 shown in these drawings joins adjacently positioned web panels 12 and 14, and comprises a bound seam 16 on a first side 18 of the adjacently joined web panels.

The bound seam 16 comprises panel margins 20 and 22 of the adjacent panels 12 and 14, respectively, such adjacent panel margins being outwardly lappingly aligned with one another and secured to one another with a first sewn binding 24.

A closure web strip 26 longitudinally extends along and is medially folded over the aligned panel margins 20 and 22, with the respective sides 30 and 32 of the closure web strip covering the stitching of the first sewn binding 24. The closure web strip is secured to the aligned panel margins with a second sewn binding 28.

As used herein, the term "longitudinally" refers to the lengthwise direction of the seam, as shown for example in the top and bottom plan views of FIGS. 2 and 3, respectively, in which the seam line 34 extends in the lengthwise direction of the seam, being formed by the mating of the adjacent panel margins, as shown in the FIG. 1 sectional elevation view.

On the second side 36 of the adjacently joined web panels 12 and 14, is disposed a liquid penetration-resistant tape 38 longitudinally and sealingly extending along the seam line 34 formed by the bound seam.

Such tape may, as more fully described hereinafter, be affixed to the seam line region on the second side of the adjacently joined panels by a suitable adhesive or bonding medium 40.

The web panels may be formed of any suitable material of construction which is useful for the intended application, i.e., end-use environment, for which the seamed panel article comprising the seam assembly is to be employed. A preferred end-use application for such seam assembly is liquid penetration-resistant protective garments.

The web panels may be of single layer or multi-layer construction, as desired. Illustrative of single ply materials which may find utility in the broad practice of the invention, are polymeric materials, such as polyethylene, polypropylene, and other polymers derived from ethylenically unsaturated monomers, including vinyl chloride, vinylidene chloride, and the like, wherein such mono-layer panels optionally may be coated, sized, impregnated, or otherwise treated as desired, with materials which further enhance the liquid penetration resistance of the material.

Alternatively, the adjacent web panels of the seam assembly of the present invention may be of laminated form, comprising a plurality of associated layers of materials such as those described in the preceding paragraph in respect of mono-layer panels. In such laminates, the respective layers may be coextruded or otherwise co-formed, or such layers may be joined to one another subsequent to their initial formation, as for example by elevated temperature interpenetration, adhesive bonding, chemical reaction between functional groups on opposing faces in the laminate, etc.

An illustrative multilayer material is a spunbonded polypropylene web coated with a film of polyethylene. Suitable polypropylene webs of such type include those marketed under the trademarks POLY-BOND® (Wayne-Tex Corporation, Waynesboro, Va.) and CELESTRA® (James River Corporation, Richmond, Va.), and such materials may be readily coated with polyethylene films, having a thickness on the order of 1.0–1.5 mils, in a known manner.

A particularly preferred laminate material for the adjacent web panels in the seam assembly of the present invention, as highly useful for the manufacture of protective garments, is a multilayer laminant, comprising TYVEK® spunbonded non-woven polyethylene web (E. I. DuPont de Nemours & Company, Inc., Wilmington, Del.), as laminated with a SARANEX® coextruded barrier film (Dow Chemical Company, Midland, Mich.), such barrier film comprising successive layers of polyethylene homopolymer, ethylene/vinyl acetate copolymer, vinylidene chloride/vinyl chloride copolymer, and ethylene/vinyl acetate copolymer.

In this TYVEK®/SARANEX® composite material, the TYVEK® web is generally uniform in composition and morphology, and thus may be bonded on either face of the sheet, while the SARANEX® film has a polyethylene layer on one facing surface, and an ethylene/vinyl acetate copolymer layer on the other, so that it is "two-sided" as regards its functional character and bondability. The facing surface of polyethylene is more highly chemically resistant, as compared to the other facing surface of ethylene/vinyl acetate (EVA). The EVA surface on the other hand, is generally more easily bonded than the polyethylene surface, which in the absence of corona treatment, chemical etching, flame spray treatment, or other adhesion-enhancing step generally has poor bonding characteristics.

Accordingly, it is generally preferred to laminate the TYVEK® web to the SARANEX® film at the ethylene/vinyl acetate facing surface of the latter material. With such construction, when the panel is employed to form a protective garment, it is preferred to position the laminate such that the TYVEK® film in the TYVEK®/SARANEX® laminate is on the body side of the wearer, e.g., on the inside of a hazardous material suit formed therefrom, while the SARANEX® film in the laminate is on the exterior side of the garment, in contact with the environment containing the liquids which it is desired to prevent from penetrating the panels and seam.

Thus, with reference to FIG. 1, the aforementioned TYVEK®/SARANEX® laminate may by deployed such that the polyethylene layer of the SARANEX® film faces outwardly on the first side 18 of the adjacently positioned panels, while the EVA face of the SARANEX® film is laminated to the TYVEK® web so that the inwardly facing surface of the TYVEK® web is at the second side 36 of the adjacently positioned panels.

The closure web strip 26 shown in FIGS. 1–3 likewise may be formed of any suitable material which is adequate to impart the desired liquid penetration resistance to the seam assembly in use. When the panels are of the aforementioned TYVEK®/SARANEX® laminated composite, the closure web strip desirably is formed of the TYVEK® material, since its spunbonded non-woven character permits it to flex readily, even when tightly stitched in place as shown, without loss of structural integrity or other deleterious effect on the strength of the seam assembly. Other spunbonded non-woven polyolefin materials may also be advantageously employed, as well as thin film or sheet materials of other suitable materials.

The respective first and second sewn bindings 24 and 28 (see FIG. 1) may be formed with any satisfactory binding material, such as polymeric filaments; natural fiber thread optionally sized with a material imparting or enhancing the liquid penetration resistance thereof, so that the thread is not liquid absorbant in character; metal wire filament; etc. For the aforementioned TYVEK®/SARANEX® laminated panels, using a TYVEK® closure web strip, bindings of polyester sewing thread have been found to perform in a highly satisfactory manner, as regards the liquid penetration resistance of the seam assembly.

The liquid penetration-resistant tape 38 (see FIGS. 1 and 3) may be formed similarly of any suitable material which is satisfactory to provide the desired liquid penetration resistance to the seam assembly. The tape is suitably a continuous film of a mono-layer or a laminate material, formed of materials such as, for example, polyolefins, polymers derived from other ethylenically unsaturated monomers, laminates thereof, etc. A particularly preferred tape material for use with the aforementioned TYVEK®/SARANEX® laminates is a SARANEX® film. As indicated, the SARANEX® film has a two-sided character, the EVA facing surface of which is more readily bonded. Accordingly, it is preferred to deploy such SARANEX® tape with its EVA surface in facing relationship to the second side 36 of the adjacently joined web panels. In such preferred construction, wherein the panels are constructed of TYVEK®/SARANEX® laminates, the SARANEX® tape is disposed in EVA surface facing relationship to the TYVEK® surface of the adjacently positioned panels.

More generally, the tape closure strip may be affixed to the second side of the adjacently adjoined panels in any suitable manner, such as by elevated temperature interpenetration, chemical bonding by reaction of functional groups on facing surfaces, adhesive bonding, etc. Adhesive bonding is generally most preferred, preferably with a pressure-sensitive adhesive material as the bonding medium.

For the aforementioned illustrative embodiment, wherein the panels are constructed of TYVEK®/SARANEX® laminates, and the tape is formed of SARANEX® film, a pressure-sensitive adhesive which has been highly satisfactory in practice is Gelva® Multipolymer Emulsion 3011 acrylic emulsion pressure-sensitive adhesive (Monsanto Company, St. Louis, Mo.). Such acrylic emulsion is applied to the surface of the tape to be bonded, and the water content thereof is removed at an elevated temperature on the order of about 100° Centigrade. The dried film of the adhesive then is subjected to high temperatures, on the order of about 150° C., to cross-link the acrylic resin component and render it pressure-sensitive in character. A release paper, backing sheet, or other bonding-resistant element may then be disposed on the adhesive surface of the tape. The tape is thus formed as a separate article comprising the pressure-sensitive adhesive, and after removal of the aforementioned bonding-resistant element, e.g., release paper, if present, the tape is then applied longitudinally to the seam line formed by the bound seam on the second side of the adjacently positioned panels, with the adhesive-bearing face of the tape in contact with the seam line, and subjected to pressure to effect the desired bonding of the tape to the seam line area.

For seam assemblies of the above-described type, wherein the pressure-sensitive adhesive is employed as a bonding medium on the tape to effect sealing of the seam line and enhance the liquid penetration resistance of the seam assembly, it is preferred that the dry film of the adhesive or bonding medium be substantially continuous, i.e., essentially free of gross macroscopic voids which may lead to anomalous bypassing or short-circuiting behavior when the seam assembly is exposed to latent liquid penetrants.

In general, tapes utilizing pressure-sensitive adhesives may be applied to the second side of the adjacently joined web panels, by passage through a nip roll, or the like, at a pressure on the tape which may typically be in the range of from about 5 to about 150 psi, with pressures of 10 to 100 psi being preferred, and 15 to 50 psi being most preferred, particularly when acrylic emulsion adhesives of the previously mentioned type are employed.

FIG. 1 shows the dimensional characteristics of the seam assembly as including a bound seam height H, and a tape width W, and a tape lateral dimension w. It is understood that in protective garment applications, the web materials of the respective panels, and the tape itself, will be typically flexible in character, so that change in the shape of the panels, and bound seam, may readily occur relative to the respective planar, and perpendicular configurations of these elements as shown in FIG. 1, it being understood that for purposes of measurement, the adjacently positioned panels are reposed on a flat surface, with the bound seam 16 extending vertically upwardly from the plane of the adjacently positioned panels. In practice, the tape width W may range from about ½ inch to 2 inches, or even greater, depending on the requirements of the end-use environment in which the seam assembly is to employed. The tape lateral dimension w preferably is approximately ½ of the full width W so that the tape extends an equal width distance from the seam line 34, on both adjacently positioned panels. The height H of the bound seam may be on the order of from about ⅜ inch to 1 inch, or more, depending on the material requirements necessary to effect proper stitching of the respective first and second sewn bindings. In preferred practice, bound seam heights on the order of ⅜ inch to ¾ inch may be advantageously employed.

The tape lateral dimension w is critical to achieving the desired high penetration resistance in the seam assembly of the invention and should be at least ¼ inch, preferably at least ½ inch, and most preferably at least ¾ inch. In relational terms, the tape width W preferably is dimensionally at least equal to the bound seam height H, and most preferably is from about 1 to about 3 times such height dimension.

It will be apparent that the dimensional characteristics, of the respective elements of the seam assembly, and their dimensional interrelationship, may be varied widely, depending on such factors as the type and character of materials used in the seam assembly and panels, the specific garment or other application in which the seam assembly is to be used and the intended use environment in which the seam assembly is intended to operate. Accordingly, the seam assembly of the present invention may be widely varied with respect to its constituent elements materials of construction, and their dimensions and dimensional interrelationships.

In the previously described illustrative commercial embodiment, utilizing TYVEK®/SARANEX® materials of construction in the constituent adjacently positioned web panels, and SARANEX® pressure-sensitive adhesive-coated tape as the closure means for the seam line on the second side of the adjacently positioned panels, the pressure-sensitive adhesive may be the aforementioned Gelva® Multipolymer Emulsion 3011 acrylic emulsion adhesive, applied at a 6 mil thick wet film thickness, and fifty percent solids, to yield a 3 mil dry film thickness. As indicated, the dry film should be substantially continuous, and essentially free of gross voids or macropores to preclude bypassing or other short-circuiting fluid penetration behavior in the operation of the seam assembly.

In the bound seam in the seam assembly of the invention, the first and second sewn bindings may be effected with any suitable type of stitching, such as so-called regular or standard stitches, safety stitches, chain stitches, etc.

Figure 4:
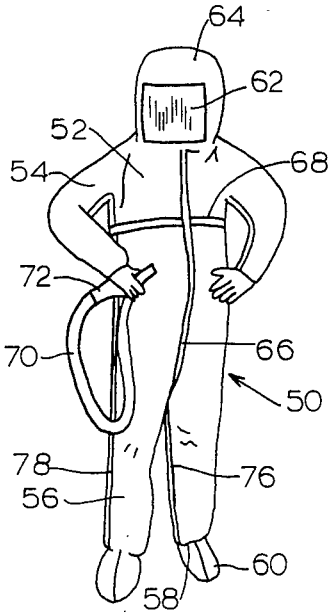
FIG. 4 is a perspective view of a protective garment utilizing seams according to the present invention.

FIG. 4 is perspective view of a hazardous material suit employing the seam assembly of the present invention at various seams thereof. The suit 50 comprises a main body portion 52, and respective arm and leg portions 54 and 56. The arm portions of the suit may be provided at the cuff ends thereof with suitable elastic gathers or other means for retaining the cuffs in position at the wrist areas of the wearer's arms.

The leg portions 56 may comprise ankle seams 58, by means of which foot portions 60 of the garment are secured thereto. In the neck region of the suit, the body portion 52 is joined to the hood 64. The hood has a frontal face shield 62, of a suitable transparent material such as Mylar® polyethylene terephthalate, Lexan® polycarbonate, etc., joined leak-tightly thereto to maximize protective efficacy of the garment in such region.

From the neck to the crotch of the garment is provided a reclosable fastener seam 66, which may comprise a locking closure of a general type as conventionally used on polyethylene sandwich and freezer bags, or alternatively, a conventional zipper with a leak-tight resealable closure associated therewith, to maximize the protection afforded by the garment at such seam.

The garment is formed with a transversely extending seam 68 at chest level on its body portion. An external air supply hose 70 and coupling extension 72 are provided on the suit so that its wearer may be joined by such means to an external air or oxygen tank or other external source of breathing gas. Alternatively, the suit may comprise a backpack-type breathing gas source.

The garment may also be formed with inseams 76 and outseams 78 along its leg portions, the outseams extending along the full length of the leg portions, the body portion, and arm portions, as shown.

The features and advantages of the invention are more fully shown with respect to the following non-limiting examples.

In order to evaluate the liquid penetration resistance of seams constructed in accordance with the invention, seam assemblies of the invention were tested against an unseamed control panel for penetration exposure to a polychlorinated biphenyl solvent mixture as hereinafter described.

EXAMPLE I

Unseamed control panel samples (Samples 1–3), each of the same construction, were formed of a laminate consisting of a TYVEK® spunbonded, nonwoven polyethylene film bonded to a SARANEX® barrier film. The TYVEK® web was adhesively bonded in face-to-face relationship to the EVA facing surface of the SARANEX® film, with Gelva® Multipolymer Resin Emulsion 3011 acrylic film adhesive (Monsanto Company, St. 10 Louis, Mo.).

Seam assembly test samples according to the present invention (Samples 4–9), each of the same construction, were constructed in the manner shown and described with reference to FIGS. 1–3 herein, using panels formed of the same material as control Samples 1–3.

In Samples 4–9, the closure web strip medially folded over the aligned panel margins was formed of TYVEK® spunbonded, non-woven polyethylene, and the respective first and second sewn bindings were sewn with a polyester sewing thread binding material. The tape at the seam line on the second side of the adjacently joined panels was formed of SARANEX® film, having its EVA facing surface in adhesive-bonded contact with the TYVEK® layer on each of the respective adjacently positioned panels. The tape bonding medium was a 3 mil (dry film thickness) layer of Gelva® Multipolymer Emulsion 3011 (Monsanto Company, St. Louis, Mo.), as initially dried at 100° C. and subsequently cross-linked at 150° C. The pressure sensitive tape was applied to the seam line area of the adjacently positioned portions of the respective panels using approximately 5 psi bonding pressure, except in the case of Sample 5, where a bonding pressure on the order of only about 2 psi was employed. The liquid penetration-resistant tape was 1.5 inches wide and extended longitudinally along the seam line in each of these seamed samples.

The respective Samples 1–9 were tested for liquid penetration resistance by the procedure of ASTM D 739-85, using as the permeation test medium, a challenge chemical mixture comprising 4% by weight polychlorinated biphenyl, 6% by weight trichlorobenzene components, and 90% by weight mineral spirits. Each of the permeation tests was run in triplicate, and each of the three samples in each triplicate run was mounted in corresponding separate Standard ASTM Chemical Permeation Cells and concurrently exposed to the challenge medium. The permeation test medium was applied to the test surface of each of the three concurrently run samples in the respective permeation cells, (the permeation cells for Samples 4–9 being modified by the provision of gaskets to accommodate the seam assemblies thereof), and the test samples were periodically monitored to determine breakthrough of the penetration challenge medium.

Samples 1–3, the unseamed control panels, were disposed in respective chemical permeation cells, and the penetration challenge medium was applied to the SARANEX® film side of the TYVEK® /SARANEX® laminate, i.e., to the polyethylene facing layer of the SARANEX® film.

Samples 4–6, comprising seam assemblies constructed according to the invention, were mounted in respective modified (gasketed) chemical permeation cells, and the penetration challenge medium was applied to the taped side (second side) of each of the samples.

Samples 7–9, also comprising seam assemblies constructed according to the invention, were likewise mounted in respective modified (gasketed) chemical permeation cells, but in contrast to Samples 4–6, the penetration challenge medium in this set of samples was applied to the bound seam side (first side) of each of the samples.

In each set of triplicate runs, the permeation chamber temperature was 23° C., while the ambient average temperature was 20° C. and ambient relative humidity was in the range of 45–50%. Analysis was performed by discrete sampling at the collection side of the permeation cells, using a 3% OV-17 100/120 Supelcoport, 6', ¼" glass gas chromatograph, at a column temperature of 170° C., a flow rate of 40 milliliters per minute, and an FID temperature of 300° C., with nitrogen as the carrier gas and isopropanol (10%) as the collection medium. The permeation cell system in all instances was operated in a closed mode. The lower detection limit for this apparatus was 0.04 ppm.

The performance data obtained in the respective triplicate runs are set forth below in Table I, together with the weight, in grams per square meter, and average thickness, in millimeters, of the panels employed in each of the samples (this thickness was measured on the main surface area of the panels and did not include the seam thickness in the seamed samples).

The performance data shown in the table include breakthrough time for permeation of the challenge medium through the sample, in minutes, and the steady-state permeation rate (the steady-state flux of the challenge medium which is established after breakthrough has occurred), in milligrams of the challenge medium per square meter of test sample per second.

TABLE I

| Sample No. | Sample Weight ($gm/m^2$) | Panel Thickness (mm) | Breakthrough Time (min) | Permeation Rate ($mg/m^2$ sec) |
|---|---|---|---|---|
| 1 | 116.56 | 0.18 | >480 | 0 |
| 2 | 118.67 | 0.18 | >480 | 0 |
| 3 | 117.25 | 0.13 | >480 | 0 |
| 4 | 216.27 | 0.15 | >480 | 0 |
| 5 | 220.06 | 0.18 | 180 | 0.3 |
| 6 | 236.25 | 0.18 | >480 | 0 |
| 7 | 223.14 | 0.18 | >480 | 0 |
| 8 | 227.86 | 0.18 | >480 | 0 |
| 9 | 234.75 | 0.15 | >480 | 0 |

In the tests of Samples 4–6, the tape separated slightly from the material on the challenge side of the samples; these tests were of "reverse" configurations as compared to those normally to be desired in protective garment applications of the invention, i.e., the side of the seam assembly which is exposed to the latent liquid penetrant in the preferred practice of the invention will be the bound seam side of the assembly, as simulated in the tests Samples 7–9. Nonetheless, even in this reverse position configuration, two out of the three samples (Samples 4 and 6) showed no breakthrough of the challenge medium after 8 hours. The sample in this triplicate test which did exhibit breakthrough, Sample 5, nonetheless resisted liquid penetration for 3 hours, substantially in excess of the minimum one hour penetration time standard previously referred to for liquids in protective garment applications.

In the case of Sample 5, the reduced breakthrough performance relative to corresponding Samples 4 and 6 was attributed to the reduced application pressure used to bond the pressure sensitive adhesive-bearing surface of the seam-sealing tape to the seam line of the assembly. For Sample 5, this application pressure was approximately 2 psi, versus about 5 psi in each of Samples 4 and 6.

With the exception of Samples 5, for the reason stated in the preceding paragraph, all other samples constructed in accordance with the invention (Samples 4 and 6–9) performed identically to the unseamed control samples (Samples 1–3) with respect to their breakthrough characteristics.

These data thus show the high liquid penetration resistance which is achieved by the seam assembly construction of the invention. As a result, protective garments comprising such seam construction afford a high level of protection against liquid penetration through the garment seams, in applications such as solvents handling and disposal, liquid spills cleanup of hazardous materials, and the like.

While preferred embodiments of the invention have been described in detail, it will be appreciated that other variations, modifications, and embodiments are possible, and accordingly all such variations, modifications, and embodiments are to be regarded as being within the spirit and scope of the invention.

What is claimed is:

1. A seam assembly for joining adjacent web panels, comprising:

(a) a bound seam on a first side of the adjacently joined web panels, comprising adjacent panel margins outwardly lappingly aligned with one another and secured to one another with a first sewn binding, and a closure web strip longitudinally extending along and medially folded over the aligned panel margins, with its respective sides covering the stitching of said first sewn binding, and secured to the aligned panel margins with a second sewn binding; and (b) a liquid penetration-resistant tape extending longitudinally and sealingly along the seam line formed by said bound seam on a second side of the adjacent web panels.

2. A seam assembly according to claim 1, wherein said web panels are formed of a material comprising a polyolefin layer.

3. A seam assembly according to claim 1, wherein said web panels are formed of a polymeric laminate.

4. A seam assembly according to claim 3, wherein said laminate comprises a sheet of spunbonded, nonwoven polyethylene, laminated with a multilayer film comprising successive layers of polyethylene; ethylene/vinyl acetate copolymer; vinylidene chloride/vinyl chloride copolymer; and ethylene/vinyl acetate copolymer.

5. A seam assembly according to claim 4, wherein said spunbonded, nonwoven polyethylene sheet is laminated in face-to-face relationship to the ethylene/vinyl acetate copolymer layer of said multilayer film.

6. A seam assembly according to claim 4, wherein said panels are arranged in said assembly with the polyethylene layer of the multilayer film being on the first side of the adjacently positioned web panels, and with said spunbonded, nonwoven polyethylene sheet on the second side of the adjacently positioned web panels.

7. A seam assembly according to claim 1, wherein said liquid permeation-resistant tape is formed of a multilayer film comprising successive layers of polyethylene; ethylene/vinyl acetate copolymer; vinylidene chloride/vinyl chloride copolymer; and ethylene/vinyl acetate copolymer.

8. A seam assembly according to claim 7, wherein said ethylene vinyl acetate copolymer layer of said tape is in face-to-face bonded relationship with said second side of said adjacently positioned web panels.

9. A protective garment article comprising a seam assembly according to claim 1.

10. A protective garment article according to claim 9, constructed and arranged to provide substantially full body protection to a human wearer thereof.

11. A method of forming a seam assembly joining adjacent web panels, comprising:

(a) positioning said panels in adjacent relationship to one another so that their main panel portions are substantially coplanar with one another in the vicinity of their junction;

(b) outwardly lappingly aligning adjacent panel margins of said adjacent panels with one another;

(c) securing said outwardly lappingly aligned panel margins to one another with a first sewn binding;

(d) positioning a closure web strip to longitudinally extend along and medially fold over the aligned panel margins, so that its respective sides cover the stitching of said first sewn binding;

(e) securing said closure web strip to the aligned panel margins with a second sewn binding; and (f) affixing a liquid penetration-resistant tape to longitudinally and sealingly extend along the seam line formed by said bound seam on a second side of the adjacently positioned web panels.

12. A process according to claim 11, comprising forming said liquid penetration-resistant tape by the steps comprising;

(i) providing a polymeric film of ribbon-like form;

(ii) applying to one side of said polymeric film a layer of a curable pressure-sensitive adhesive forming composition;

(iii) curing said applied composition to form a layer of pressure-sensitive adhesive on said film, and yield the adhesive-coated film as said liquid penetration-resistant tape.

* * * * *